US006347976B1

(12) United States Patent
Lawton et al.

(10) Patent No.: US 6,347,976 B1
(45) Date of Patent: Feb. 19, 2002

(54) COATING REMOVAL SYSTEM HAVING A SOLID PARTICLE NOZZLE WITH A DETECTOR FOR DETECTING PARTICLE FLOW AND ASSOCIATED METHOD

(75) Inventors: Stanley Allen Lawton, St. Louis; John Daniel Kelley, Creve Coeur; Wayne Nicholas Schmitz, St. Louis, all of MO (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/451,284

(22) Filed: Nov. 30, 1999

(51) Int. Cl.[7] ..... B24B 49/00; B24B 51/00
(52) U.S. Cl. ..... 451/6; 451/38
(58) Field of Search ..... 451/5, 6, 28, 38, 451/40, 41, 60

(56) References Cited

U.S. PATENT DOCUMENTS

| | | | | |
|---|---|---|---|---|
| 3,677,086 | A | | 7/1972 | Corey |
| 3,678,746 | A | | 7/1972 | Corey |
| 3,686,937 | A | | 8/1972 | Corey |
| 4,346,606 | A | | 8/1982 | Cannon et al. |
| 4,681,563 | A | | 7/1987 | Deckert et al. |
| 4,743,760 | A | | 5/1988 | Giles |
| 5,126,621 | A | | 6/1992 | Morton et al. |
| 5,166,667 | A | | 11/1992 | Jen |
| 5,194,723 | A | | 3/1993 | Cates et al. |
| 5,204,517 | A | | 4/1993 | Cates et al. |
| 5,281,798 | A | | 1/1994 | Hamm et al. |
| 5,309,215 | A | * | 5/1994 | Schumann ..... 451/6 |
| 5,328,517 | A | | 7/1994 | Cates et al. |
| 5,411,052 | A | | 5/1995 | Murray |
| 5,559,339 | A | | 9/1996 | Domanik et al. |
| 5,571,335 | A | | 11/1996 | Lloyd |
| 5,613,509 | A | * | 3/1997 | Kolb et al. |
| 5,660,580 | A | | 8/1997 | Lehnig |
| 5,699,679 | A | | 12/1997 | Wu et al. |
| 5,782,253 | A | | 7/1998 | Cates et al. |
| 5,795,214 | A | | 8/1998 | Leon |

* cited by examiner

*Primary Examiner*—Derris H. Banks
(74) *Attorney, Agent, or Firm*—Alston & Bird LLP

(57) ABSTRACT

An apparatus is provided for removing a coating from a substrate, comprising a nozzle having an outlet and adapted to direct a particle stream therethrough at a predetermined flow rate, a signal source for emitting a signal capable of traversing the particle stream, and a signal sensor positioned to detect the signal emitted by the signal source once the signal has passed through the particle stream. The particle stream is directed from the outlet of the nozzle toward a coating on a substrate to remove the coating from the substrate. Since the signal emitted by the signal source traverses the particle stream before being detected, the intensity of the signal detected by the signal sensor corresponds to a flow rate of the particle stream such that a subsequent change in the intensity of the signal that is detected by the signal sensor indicates a change in the flow rate of the particle stream. A method of monitoring a particle flow in an apparatus used for removing a coating from a substrate is also provided.

18 Claims, 5 Drawing Sheets

COATING REMOVAL SYSTEM HAVING A SOLID PARTICLE NOZZLE WITH A DETECTOR FOR DETECTING PARTICLE FLOW AND ASSOCIATED METHOD

FIELD OF THE INVENTION

The present invention relates to coating removal systems and, more particularly, to a coating removal system having a solid particle nozzle with a detector for detecting particle flow and associated method.

BACKGROUND OF THE INVENTION

The use of composite structures manufactured, for example, of graphite epoxy or other reinforced plastic materials has become increasingly common. Reinforced composite materials, including graphite epoxy materials, are extensively employed for surface structures in aircraft and automobile construction. These structures are often painted for a variety of reasons, including aesthetics, identification, and camouflage. However, such painted surfaces deteriorate under the action of weather and the mechanical forces to which they are subjected, thus requiring periodic removal and replacement of the paint.

The removal of paint and/or other coating from the large and often delicate surfaces, as typically found on aircraft and automobiles, is a difficult process which can be compounded by topological anomalies such as rivets or even complex curvature. Techniques such as particle medium blasting (PMB) and mechanical grinding, that are sufficiently energetic to remove paint by themselves, tend to damage composite materials. Paint removal with chemical agents is likewise unsatisfactory since the chemicals tend to attack the organic binder in the composite as well as the paint. Further, high temperature paint removal methods may produce deleterious effects in heat-sensitive composites. Other than labor-intensive hand sanding, one effective method of removing materials such as paint, radar absorbing material (RAM), other coating adhesives, and excess resin from a composite structure comprises using both radiant energy and a particle stream to remove the material or coating adhering to the surface of the substrate.

According to this method of removing a coating from a substrate, the coating is first heated with a pulsed radiant energy source such that the coating is pyrolized and vaporized from the surface. Pyrolisis of the coating reduces the cohesion of the material to itself and its adhesion to the underlying substrate. Any remaining pyrolized coating is able to be removed by a relatively low-power particle stream since this pyrolized coating does not adhere well to the surface of the substrate. Typically the preferred particle stream comprises $CO_2$ pellets that act both as an abrasive agent for removing pyrolized coating and a cooling agent for cooling the underlying substrate. Thus, the pulsed radiant energy source generally accomplishes most of the coating removal while the particle stream is useful for removing any residue as well as for cooling the substrate.

In a typical form, the coating removal apparatus comprises a central radiant energy source having an adjacent particle nozzle aimed so as to direct the particle stream alongside and slightly behind the radiant energy source relative to the direction of movement of the radiant energy source with respect to the substrate. The radiant energy source provides intense repetitive flashes of broadband (ranging from infrared to ultraviolet) radiation to pyrolize and remove the coating from the substrate. The particle stream is then directed at the remaining pyrolized coating such that the still-hot pyrolized coating is almost immediately removed from the surface of the substrate. A vacuum system is also generally provided adjacent the radiant energy source for collecting the waste removed from the substrate.

The particle stream may comprise, for example, carbon dioxide pellets suitable for removing the residue of the ablated coating from the substrate. Usually, it is desirable for the particle stream to be at a temperature well below the ambient temperature in order to quickly cool the substrate such that the substrate does not sustain heat damage. Generally, the particle stream is delivered from a remote source to the nozzle through a duct or feed line, where the nozzle is configured to provide the desired pattern or footprint of the particles exiting the nozzle for optimizing the removal effect of the particles. However, where the nozzle outlet is shaped as, for example, an elongated rectangle, the minor width may be just sufficient for the pellets to flow through. Occasionally, such a nozzle may become clogged from the pellets supplied from the source. In addition, condensing moisture about the outlet of the nozzle may also cause the nozzle to become clogged.

When the nozzle becomes clogged, the cessation of the flow of particles may result in several detrimental effects. For example, the pellet source may continue to produce the pellets and attempt to deliver the pellets to the nozzle, thereby possibly damaging the source if the clog is not expediently discovered and the nozzle unclogged. Further, the radiant energy source may continue to pyrolize the coating without having the pellets flowing from the nozzle to remove the pyrolized coating and provide the necessary cooling for the substrate, thereby possibly leading to heat damage of the substrate. Heat damage to the substrate may result from either the absence of the cooling effect of the pellets resulting from the clogged nozzle and/or the heat imparted by a subsequent pass of the coating removal system, once the nozzle has been unclogged, over the portion of the substrate already having the coating pyrolized in the previous pass of the coating removal system. Current coating removal systems of the radiant energy/particle stream type utilize, for instance, thermocouples in the nozzle feed duct to sense and detect pellet flow in the duct. However, the thermocouples are typically placed close to the pellet source and generally have a slow response time, thereby resulting in a delay in detecting loss of pellet flow due to blockage of the nozzle and/or the feed duct between the thermocouples and the nozzle outlet. Thus, there exists a need for an effective device and method for short response time detection of a clogged nozzle outlet in a radiant energy/particle stream coating removal system in order to prevent possible damage to the substrate and/or the apparatus. The detection system is preferably simple, readily implemented, and capable of reliably indicating the status of the pellet flow at the outlet of the nozzle.

SUMMARY OF THE INVENTION

The above and other needs are met by the present invention which, in one embodiment, provides an apparatus for removing a coating from a substrate comprising a nozzle having an outlet and adapted to direct a particle stream therethrough at a predetermined flow rate, a signal source for emitting a signal capable of traversing the particle stream, and a signal sensor positioned to detect the signal emitted by the signal source once the signal has passed through the particle stream. The particle stream is directed from the outlet of the nozzle toward a coating on a substrate to remove the coating from the substrate. The signal sensor is adapted to detect an intensity of the signal emitted by the signal source, once the signal has passed through the particle stream, such that subsequent changes in the intensity of the signal that are detected by the signal sensor indicate a change in the flow rate of the particle stream.

According to one advantageous embodiment of the present invention, the signal source may be, for example, a light emitting diode, a laser, an incandescent lamp, a gas discharge lamp, or the like that is capable of emitting light comprising at least one wavelength. Accordingly, the signal sensor may be, for example, a photodiode, a photomultiplier, a bolometer, or the like capable of detecting the at least one wavelength of light emitted by the signal source. To further facilitate removal of the coating, the apparatus may further include a radiant energy source disposed adjacent the nozzle, wherein the radiant energy source irradiates a target area of the coating with a quantity of energy sufficient to at least pyrolize the coating.

Since the radiant energy source exposes the coating to intense, repetitive flashes of broadband (infrared to ultraviolet) radiation to condition the coating for removal by the particle stream, and since the signal source and sensor comprise an optical detection system in some embodiments of the present invention, the signal source and the signal sensor are preferably configured such that interference from the radiant energy source is minimized. In addition, since the signal source and sensor are exposed to a harsh environment about the outlet of the nozzle, embodiments of the present invention further include a shielding device for shielding each of the signal source and the signal sensor from, for instance, the particle stream and/or condensing water vapor. Typically, the particle stream is comprised of carbon dioxide pellets and the signal source and the signal sensor are disposed either within or externally to the nozzle adjacent to the outlet.

A further advantageous aspect of the present invention comprises a method of monitoring a particle flow in an apparatus used for removing a coating from a substrate. First, a particle stream having a predetermined flow rate is flowed through a nozzle having an outlet. The particle stream is directed from the outlet of the nozzle toward a coating on the substrate for removing the coating therefrom. As the particle stream flows through the nozzle, a signal is emitted from a signal source such that the signal traverses the particle stream. The signal is then detected with a signal sensor once the signal has traversed the particle stream. In some particularly advantageous embodiments, detecting the signal comprises detecting an intensity of the signal at the signal sensor which corresponds to a predetermined flow rate of the particle stream such that subsequent changes in the intensity of the signal at the signal sensor indicates a change in the flow rate of the particle stream from the predetermined flow rate. In some instances, the particle stream comprises, for example, carbon dioxide pellets.

In a particularly advantageous embodiment, the signal source and the signal sensor comprise an optical detection system wherein the emitting step comprises emitting a light comprising at least one wavelength from the signal source and the detecting step comprises detecting the at least one wavelength of light emitted from the signal source with the signal sensor. The emitting and detecting steps further preferably occur adjacent to the outlet of the nozzle and either within or externally thereto. Embodiments of the method according to the present invention may further include the step of shielding each of the signal source and the signal sensor with a shielding device during the flowing step, wherein the shielding device may be configured to direct a gas purge flow across each of the signal source and the signal sensor.

Thus, embodiments of the device and method according to the present invention are capable of detecting a reduced flow or a blockage of the particle stream about the outlet of the nozzle and transmitting this information to the device control system with a short response time, thereby reducing the possible damage to the substrate and/or other detrimental effects resulting from an abnormally low flow of the particle stream. Since the signal source and the signal sensor may be readily implemented in existing configurations of coating removal systems, embodiments of the present invention are relatively simple, readily implemented, and capable of reliably indicating the status of the particle stream flow at the outlet of the nozzle.

BRIEF DESCRIPTION OF THE DRAWINGS

Some of the advantages of the present invention having been stated, others will appear as the description proceeds, when considered in conjunction with the accompanying drawings, which are not necessarily drawn to scale, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
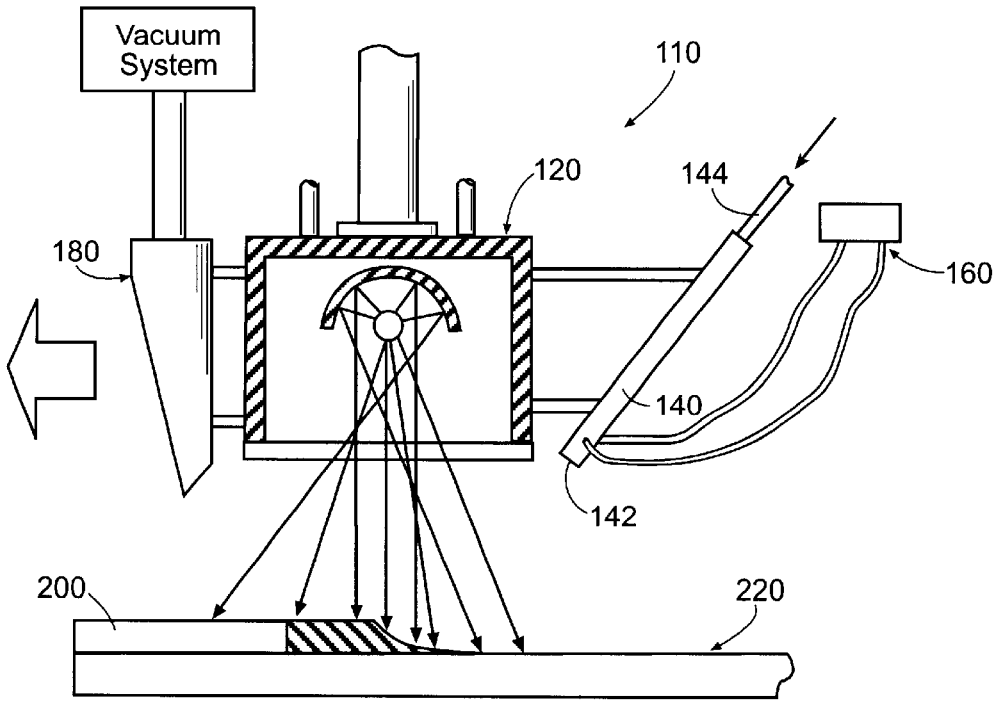
FIG. 1 is a side elevation of one example of a radiant energy/particle stream coating removal device.

FIG. 1 discloses an embodiment of an apparatus for removing a coating from a substrate, the apparatus being indicated generally by the numeral 110, which includes the features of the present invention. The coating removal system 110 generally comprises a radiant energy source 120, a solid particle nozzle 140, a particle flow detection system 160, and a vacuum system 180 which cooperate to remove a coating 200 from a substrate 220. Generally, the coating removal system 110 is placed adjacent to the coating 200 on the substrate 220. A target area of the coating 200 is then irradiated by the radiant energy source 120 with radiant energy sufficient to break or weaken chemical bonds in the coating 200 in a pyrolization process. The target area is then bombarded with a particle stream emitted from the outlet 142 of the nozzle 140 which ablates the pyrolyzed coating 200 from the substrate 220. The ablated material is then collected by the vacuum system 180 in order to prevent the ablated material from obstructing the continued operation of the coating removal system 110. The structure and operation of such a coating removal system 110 is further described in U.S. Pat. Nos. 5,328,517 and 5,782,253 to Cates et al., herein incorporated in their entirety by reference.

Figure 2:
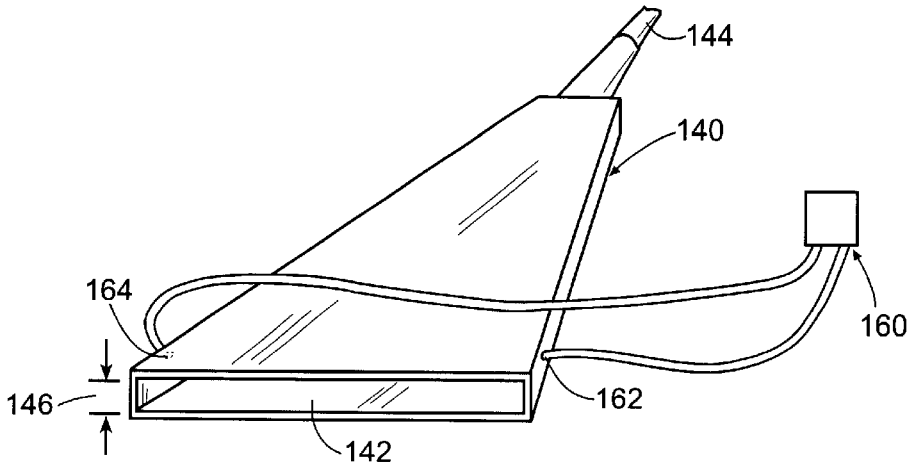
FIG. 2 is a perspective view of one example of a solid particle nozzle.

In one advantageous embodiment of the present invention, the coating removal system 110 emits frozen particles such as, for example, frozen $CO_2$ particles or pellets to remove the coating 200 pyrolyzed by the radiant energy source 120. As shown in FIG. 2, the nozzle 140 is preferably configured to deliver the frozen $CO_2$ pellets from a pellet source (not shown) along a feedline 144 to the nozzle 140, where the $CO_2$ pellets exit through the nozzle outlet 142. The pattern or footprint of the particle stream emitted by the nozzle 140 is typically determined by the size and shape of the nozzle outlet 142. However, the nozzle 140 must also be configured such that the outlet 142 is sufficient for the pellets or fragments thereof to flow and such that the nozzle 140 does not clog due to condensing moisture or the pellets themselves. For example, a nozzle 140 having a rectangularly-shaped outlet 142 for pellets having an average size of 0.125 inches may have a minimum minor width 146 at the outlet 142 of about 0.062 inches. The small dimension of the minor width 146 compared to the average size of the pellets is provided such that the pellets are shattered or otherwise caused to disintegrate upon exiting the nozzle 140, thereby providing a certain footprint of the pellet fragments. The flow of pellets at a predetermined rate and with a specific footprint is critical for the proper operation of the coating removal system 110. Less than optimal pellet flow may result in, for example, overheating and degradation of the substrate 220 and damage to the nozzle 140 and/or the pellet supply source (not shown). Accordingly, advantageous embodiments of the present invention further include a detection system 160 for monitoring the pellet flow through the nozzle 140 adjacent to the nozzle outlet 142.

Figure 3A:
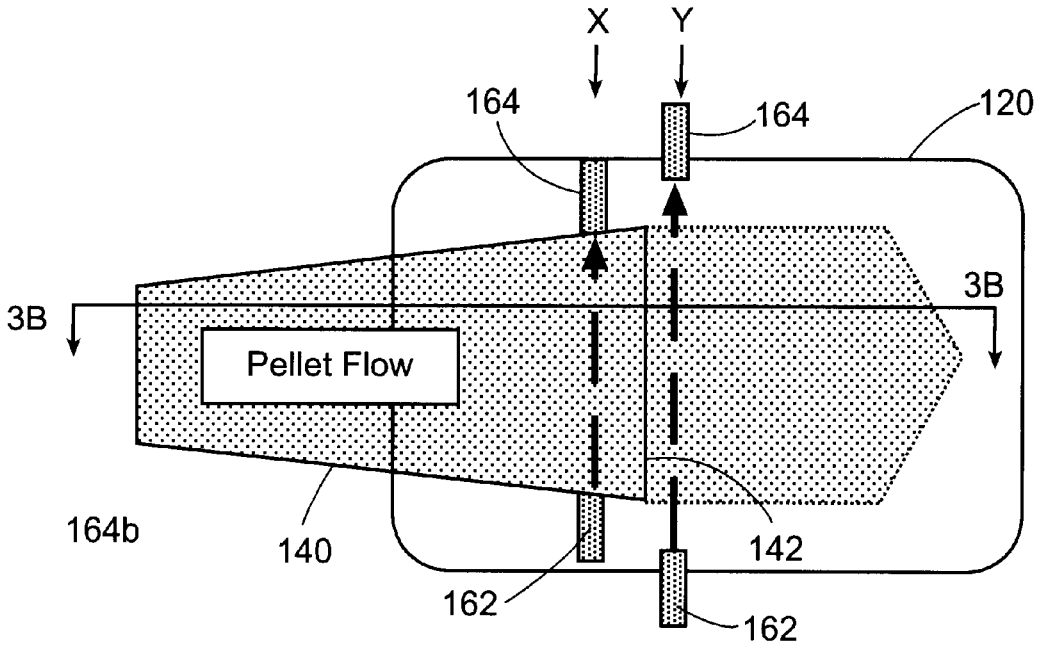
FIG. 3A is a plan view of a coating removal device according to one embodiment of the present invention illustrating the disposition of a detection system within or externally to the nozzle.
Figure 3B:
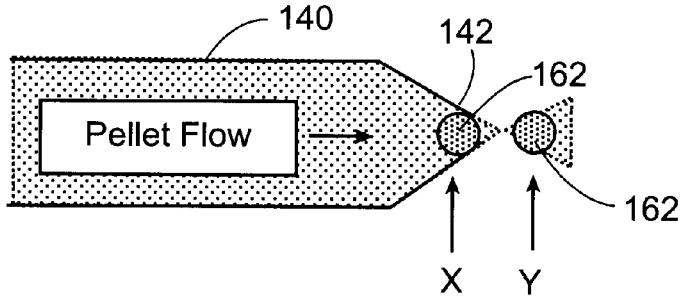
FIG. 3B is a cross-sectional view of a coating removal system according to one embodiment of the present invention illustrating the disposition of a detection system within or externally to the nozzle and taken along line 3B—3B of FIG. 3A.

As shown in FIGS. 2, 3A, and 3B, the detection system 160 generally comprises a signal source 162 capable of emitting a signal. Preferably, the signal source 162 is disposed adjacent to the outlet 142 such that the emitted signal is directed to traverse the particle stream. The detection system 160 further includes a signal sensor 164 positioned so as to detect the signal emitted by the signal source 162, once the signal has passed through the particle stream. In one particularly advantageous embodiment, the signal sensor 164 is adapted to detect an intensity of the signal which corresponds to a predetermined flow rate of the particle stream. For example, at the desired flow rate of the $CO_2$ pellets from the nozzle outlet 142 to produce the desired footprint and ablation of the coating 200 on the substrate 220, only a certain amount of the signal emitted by the signal source 162 will traverse the particle stream and be detected by the signal sensor 164. Therefore, at the desired flow rate of the particle stream, the detection system 160 is capable of determining a corresponding intensity of the signal traversing the particle stream. As such, any subsequent change in the intensity of the signal that is detected by the signal sensor 164 will indicate a change in the flow rate of the particle stream. For example, where the signal source 162 and the signal sensor 164 are disposed within the nozzle 140 adjacent to the outlet 142 and the nozzle 140 or the feedline 144 becomes clogged due to condensed moisture and/or the $CO_2$ pellets, the intensity of the signal detected by the detection system 160 will increase since the blockage upstream of the detection system 160 would better enable the signal to traverse the nozzle 140 and to reach the signal sensor 164. The change in the intensity of the detected signal may then be used to notify the control system (not shown) of the coating removal system 110 and/or the operator of the blockage in the nozzle 140 or the feedline 144 such that corrective action may be taken. Preferably, the detection system 160 has a short response time, for example, such as less than 50 milliseconds, and is capable of notifying the control system of the coating removal system 110 and/or the operator before the substrate 220 and/or the coating removal system 110 are damaged.

In order to accomplish the described monitoring of the flow of the particle stream through the nozzle 140, the signal source 162 and the signal sensor 164 may be disposed within the nozzle 140 adjacent the outlet 142 (shown as position X in FIGS. 3A and 3B). Alternatively, the signal source 162 and the signal sensor 164 may be disposed externally to the nozzle 140 adjacent to the outlet 142 (shown as position Y in FIGS. 3A and 3B).

Figure 4:
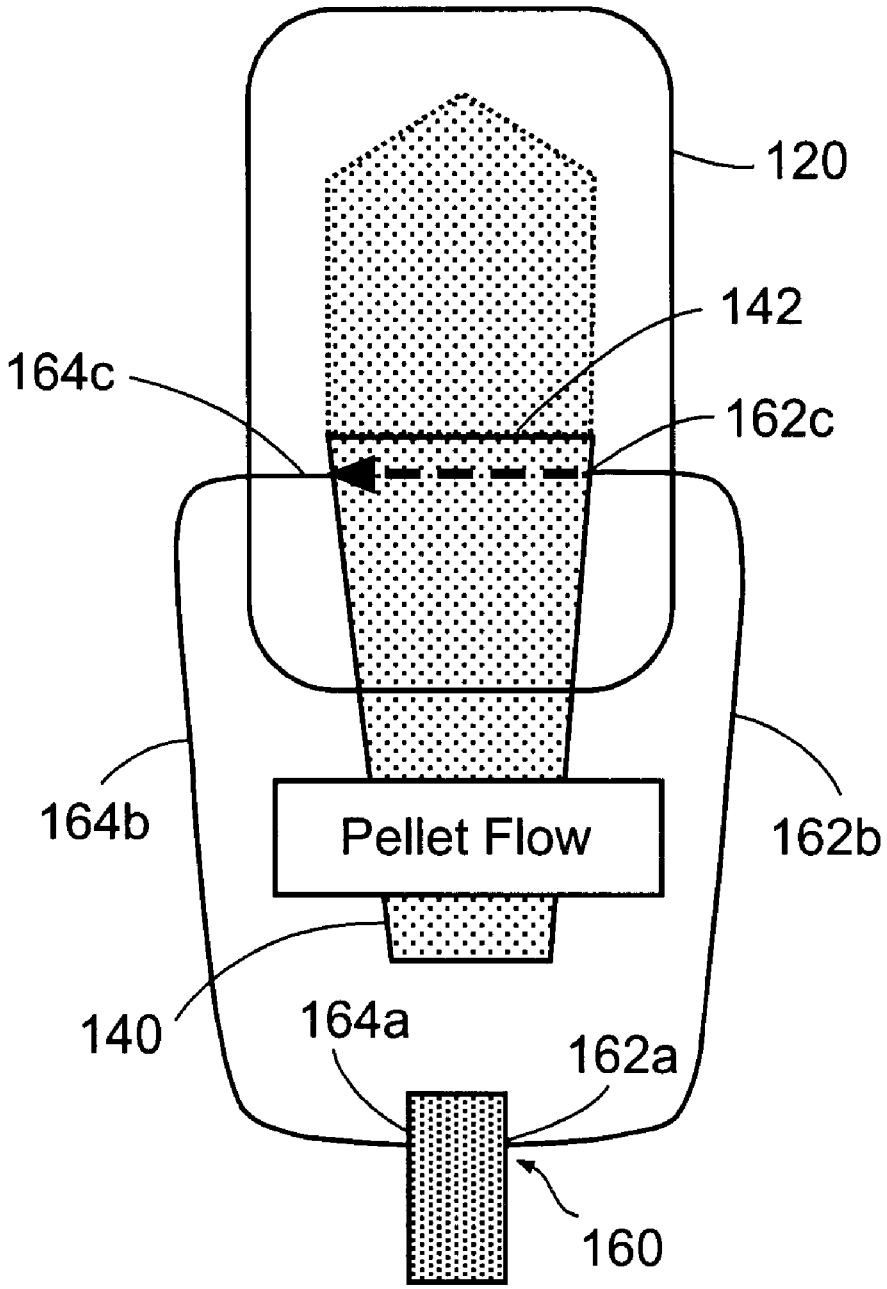
FIG. 4 is a plan view of a coating removal system according to an alternate embodiment of the present invention illustrating a remote detection system connected to the nozzle by fiber optic cables.
Figure 5:
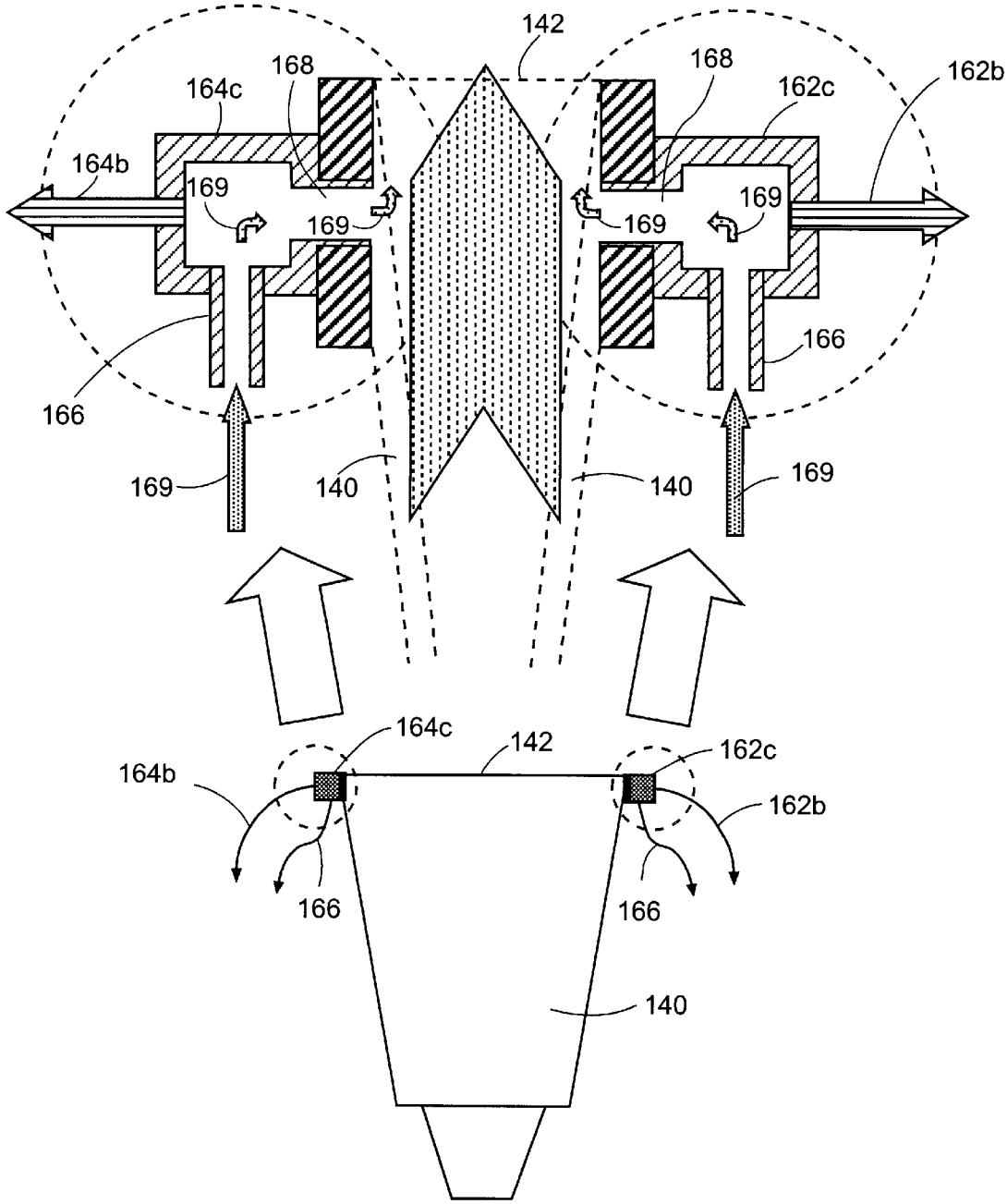
FIG. 5 is a cross-sectional schematic view of a coating removal system according to one embodiment of the present invention illustrating a detection system disposed within the nozzle and adjacent the outlet (position X in FIGS. 3A and 3B) having fiber optic cables connected to the nozzle which are each protected by a shielding device.
Figure 6:
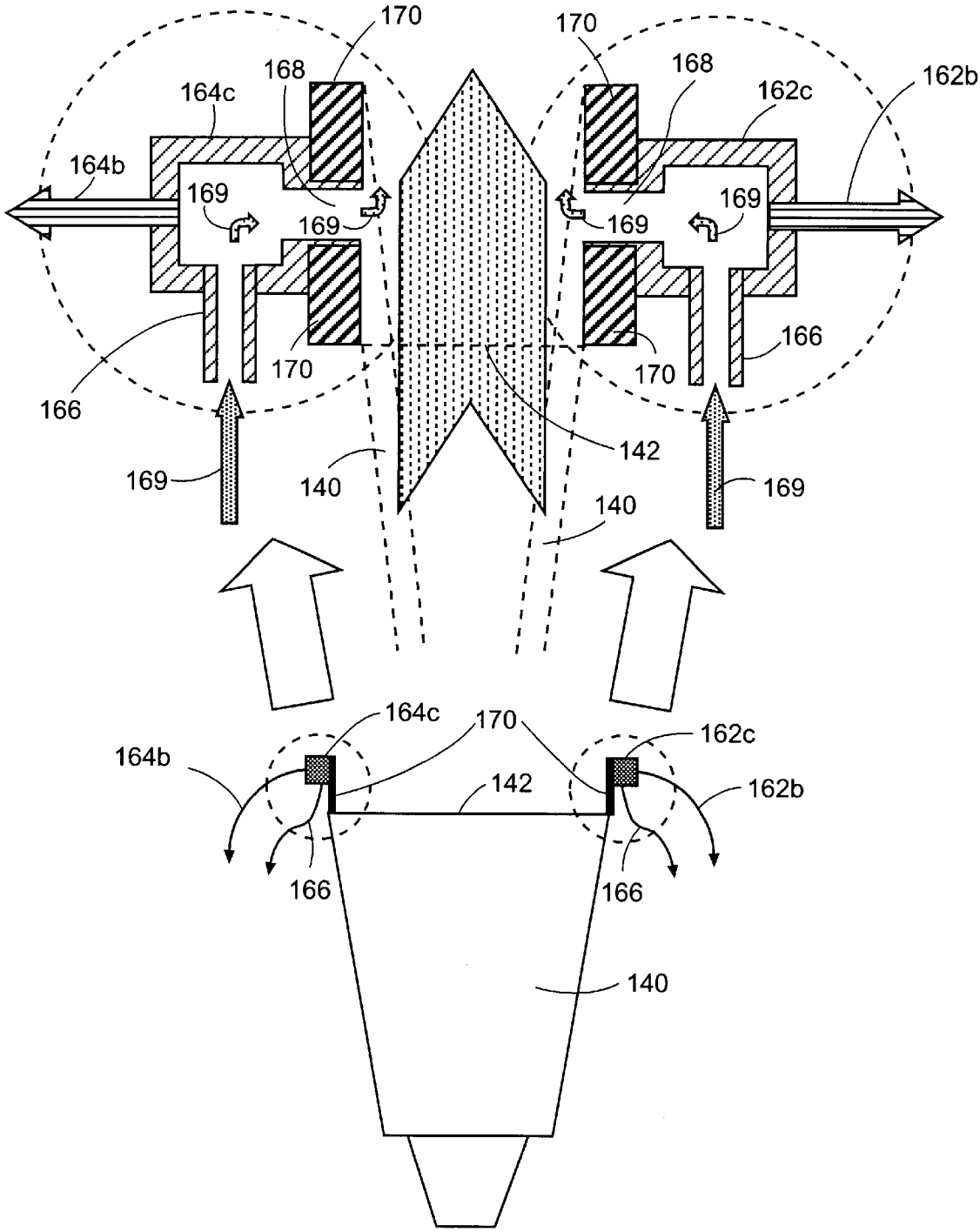
FIG. 6 is a cross-sectional schematic view of a coating removal system according to one embodiment of the present invention illustrating a detection system disposed externally to the nozzle (position Y in FIGS. 3A and 3B) having fiber optic cables connected to the nozzle which are each protected by a shielding device.

The environment adjacent the outlet 142 of the solid particle nozzle 140 is typically a harsh environment which is subject both to the abrasive $CO_2$ particles as well as extreme cold and condensing water vapor due to the flow of the $CO_2$ pellets. Thus, in one particularly advantageous embodiment of the present invention as shown in FIG. 4, the detection system 160 may comprise a signal source 162*a* and a signal sensor 164*a* disposed remotely to the outlet of the nozzle 142. As shown in FIGS. 5 and 6, the signal source 162*a* and the signal sensor 164*a* are then connected to corresponding sensing ports 162*c* and 164*c* disposed within or externally to the nozzle 140 adjacent the outlet 142 by connectors 162*b* and 164*b* which may comprise, for example, fiber optic cables. This may be accomplished, for instance, through the use of a commercially available detection system, such as Catalog No. HPX-X1-H using interconnecting fiber optic cables Catalog No. HPF-T001-H, both manufactured by the Honeywell Micro Switch Sensing and Control Division. As shown in FIG. 5, fiber optic cables and, more particularly, the signal source and sensor fiber optic cables 162*b*, 164*b*, may be connected into the nozzle 140 adjacent the outlet 142 by sensing ports 162*c*, 164*c* operably connected through the wall of the nozzle 140. Preferably, the fiber optic cables 162*b*, 164*b* and the sensing ports 162*c*, 164*c* are disposed such that the fiber optic cables 162*b*, 164*b* have unobstructed pathways thereto from the interior of the nozzle 140. The sensing ports 162*c*, 164*c* may each further include a fitting 166 operably connected thereto between the fiber optic cable 162*b*, 164*b* and the outlet 168 of the respective sensing port 162*c*, 164*c*. Preferably, connected to each fitting 166 is a purge gas flow 169 for directing a purge gas through the fitting 166, into the interior of the respective sensing port 162*c*, 164*c*, and through the outlets 168 into the interior of the nozzle 140. The purge gas flow 169 therefore prevents contaminants from entering into the sensing ports 162*c,* 164*c* and protects the fiber optic cables 162*b,* 164*b* from contaminants that would affect the performance of the detection system 160. FIG. 6 illustrates an embodiment of the present invention wherein the sensing ports 162*c,* 164*c* are disposed externally to the nozzle 140 and each connected thereto by a bracket 170. The configuration and function of the fiber optic cables 162*b,* 164*b* comprising portions of the detection system 160 are otherwise the same as the embodiment discussed in FIG. 5.

According to embodiments of the present invention, the detection system 160 may comprise a signal source 162 that emits light comprising at least one wavelength such as, for example, a light-emitting diode, a laser, an incandescent lamp, or the like. Accordingly, the signal sensor 164 is preferably capable of detecting the at least one wavelength of light emitted by the signal source 162 and may comprise, for example, a photodiode, a photomultiplier, a bolometer, or like devices capable of detecting the light emitted by the signal source 162. In a particularly advantageous embodiment, the detection system 160 comprises a photoelectric sensor device operably connected to the nozzle 140 with fiber optic couplings and cables. However, since the radiant energy source 120 utilizes intense, repetitive flashes of broadband (infrared to ultraviolet) radiation to pyrolize the coating 200, it is preferred that the light flashes provided by the radiant energy source 120 do not interfere with an optical detection system 160 of the type described. Therefore, interference between the radiant energy source 120 and the detection system 160 may be minimized, for example, by gating the signal sensor 164 and its associated electronics into an "off" mode during a flash from the radiant energy source 120 or, for instance, by modulating the signal intensity at a particular frequency of light and using synchronous detection at the signal sensor 164. In addition, it is preferred that both the signal source 162 and the signal sensor 164 be configured to have a purge flow of dry air or another gas thereacross to prevent, for example, moisture condensation or contamination of the signal source 162 and the signal sensor 164. Such an arrangement would provide a gas purge flow for shielding the signal source 162 and the signal sensor 164 from abrasive particles and/or the extreme cold while the particle stream is flowing and from ambient humidity when the particle stream is not flowing. In addition, it is understood that the number and the positions of the signal sources and signal sensors may vary according to the requirements of a particular application within the spirit and scope of the present invention. For example, a number of detection systems 160 may be implemented along the feed duct 144 and the nozzle 140 to allow for detection of the actual location of a clog.

Thus, a detection system for the solid particle nozzle in a coating removal system according to embodiments of the present invention provides an easily implemented and relatively inexpensive method of assessing the condition of the outlet of the solid particle nozzle to inform the control system of the coating removal device and/or the operator if there is a blockage impeding the flow of the particle stream through the nozzle in order to prevent damage to the composite substrate and/or the coating removal system. Embodiments of the apparatus and method according to the present invention further provide a detection system with a fast response time for expediently detecting the presence of a blockage in the nozzle. Thus, embodiments of the present invention provide significant advantages over current coating removal systems utilizing radiant energy and a particle stream for removing coatings from a composite structure as herein described.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for removing a coating from a substrate; said apparatus comprising:

a nozzle having an outlet and adapted to direct a particle stream therethrough at a predetermined flow rate, the particle stream being directed from the outlet toward a coating on a substrate to remove the coating from the substrate;

a signal source for emitting a signal capable of traversing the particle stream; and a signal sensor positioned to detect the signal emitted by the signal source once the signal has passed through the particle stream, the signal sensor adapted to detect an intensity of the signal which corresponds to a flow rate of the particle stream such that subsequent changes in the intensity of the signal that are detected by the signal sensor indicate a change in the flow rate of the particle stream.

2. An apparatus according to claim 1 wherein the signal source is at least one of a light-emitting diode, a laser, an incandescent lamp, and a gas discharge lamp.

3. An apparatus according to claim 2 wherein the signal sensor is at least one of a photodiode, a photomultiplier, and a bolometer.

4. An apparatus according to claim 1 further including a radiant energy source disposed adjacent the nozzle and the coated substrate, the radiant energy source for generating radiant energy and irradiating a target area of the coating with a quantity of energy sufficient to at least pyrolize the coating.

5. An apparatus according to claim 4 wherein the signal source and the signal sensor are configured such that interference from the radiant energy source is minimized.

6. An apparatus according to claim 1 further including a shielding device for shielding each of the signal source and the signal sensor.

7. An apparatus according to claim 6 wherein the shielding device is configured to direct a gas purge flow across each of the signal source and the signal sensor.

8. An apparatus according to claim 1 wherein the nozzle is adapted to direct a particle stream of carbon dioxide pellets therethrough.

9. An apparatus according to claim 1 wherein the signal source and the signal sensor are disposed within the nozzle adjacent to the outlet.

10. An apparatus according to claim 1 wherein the signal source and the signal sensor are disposed externally to the nozzle adjacent to the outlet.

11. A method of monitoring a particle flow in an apparatus used for removing a coating from a substrate, said method comprising:

flowing a particle stream having a predetermined flow rate through a nozzle having an outlet;

directing the particle stream from the outlet toward a coating on the substrate;

emitting a signal that traverses the particle stream;

detecting the signal once the signal has traversed the particle stream, detecting the signal comprising detecting an intensity of the signal which corresponds to a predetermined flow rate of the particle stream such that subsequent changes in the intensity of the signal indicate a change in the flow rate of the particle stream from the predetermined flow rate.

12. A method according to claim 11 wherein the flowing step further comprises flowing a particle stream of carbon dioxide pellets through the nozzle.

13. A method according to claim 11 wherein the emitting and detecting steps further comprise emitting and detecting the signal within the nozzle and adjacent to the outlet.

14. A method according to claim 11 wherein the emitting and detecting steps further comprise emitting and detecting the signal externally to the nozzle and adjacent to the outlet.

15. A method according to claim 11 wherein the signal is emitted by a signal source and detected by a signal sensor and wherein the method further includes the step of shielding each of the signal source and the signal sensor during the flowing step.

16. A method according to claim 15 wherein the shielding step further comprises directing a gas purge flow across each of the signal source and the signal sensor.

17. A method according to claim 11 wherein the emitting step further comprises gating the signal such the signal selectively traverses the particle stream.

18. A method according to claim 11 wherein the emitting and detecting steps further comprise modulating the signal at a predetermined frequency at which detection occurs.

* * * * *